United States Patent [19]

Warde

[11] 4,291,870

[45] Sep. 29, 1981

[54] VICES

[76] Inventor: Laurence Warde, Rosevilla, Station Rd., Ballinasloe, County Galway, Ireland

[21] Appl. No.: 97,988

[22] Filed: Nov. 28, 1979

[51] Int. Cl.[3] ..... B25B 1/24
[52] U.S. Cl. ..... 269/279
[58] Field of Search ..... 269/279-284, 269/247

[56] References Cited

U.S. PATENT DOCUMENTS

| | | | |
|---|---|---|---|
| 890,063 | 6/1908 | Jones | 269/279 |
| 2,570,857 | 10/1951 | Purpura | 269/279 |
| 2,653,499 | 9/1953 | Partiss | 269/280 |

*Primary Examiner*—Robert C. Watson
*Attorney, Agent, or Firm*—James & Franklin

[57] ABSTRACT

A vice in which the gripping surfaces are formed on a pair of blocks, each of which has a number of gripping surfaces. Each block is detachably mounted on the vice and may be replaced by another block and/or turned on the vice to enable two of a plurality of gripping surfaces to be brought into mutual opposition.

10 Claims, 6 Drawing Figures

VICES

BACKGROUND OF THE INVENTION

The present invention relates to vices. Conventional vices have a pair of gripping surfaces between which a workpiece may be clamped.

One disadvantage of conventional vices is that the two gripping surfaces are of standard size and shape.

SUMMARY OF THE INVENTION

According to the present invention, there is provided a vice in which at least one of the pair of gripping surfaces can be replaceable by some other gripping surface.

Advantageously, the replaceable gripping surface is formed on a block which is adapted to be mounted on the vice. The block may have a plurality of different gripping surfaces, and may be turned to bring one of the plurality of gripping surfaces into opposition with the other of the pair of gripping surfaces.

Advantageously, each of the gripping surfaces of the pair of gripping surfaces may be provided on one of a pair of blocks, each of which contains a plurality of gripping surfaces, and each block is adapted to be detachably mounted on a support provided on the vice.

In the construction in which both jaw blocks are replaceable, each jaw block may have gripping surfaces which are identical with or which correspond to gripping surfaces on the other jaw block, so that the two jaw blocks are adapted to be rotated or orientated to bring identical or corresponding gripping surfaces into face-to-face confrontation as in a conventional vice. Each jaw block may be removable from the vice or other device and may be replaceable by another jaw block which may have dimensions and gripping surfaces different from the replaced jaw block.

BRIEF DESCRIPTION OF THE DRAWINGS

The invention will hereinafter be described more particularly with reference to the accompanying drawings which illustrate, by way of example only, a preferred embodiment.

In the drawings.

DESCRIPTION OF THE PREFERRED EMBODIMENT

Figure 1:
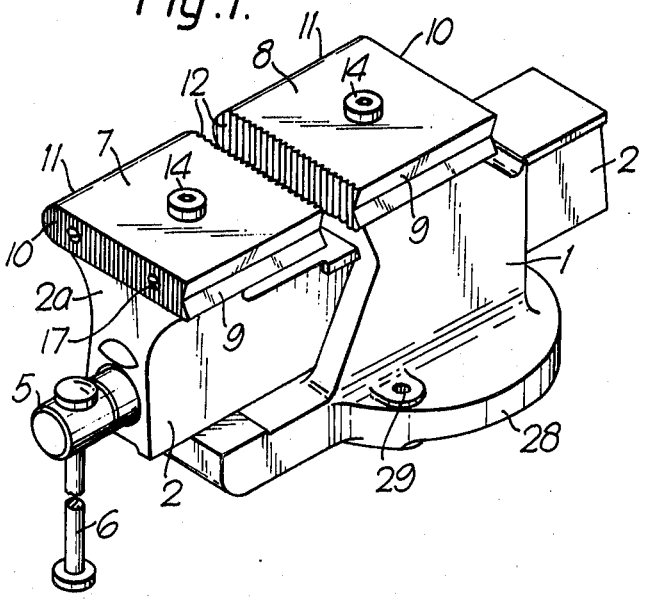
FIG. 1 is a perspective view of a vice constructed in accordance with the invention.
Figure 2:
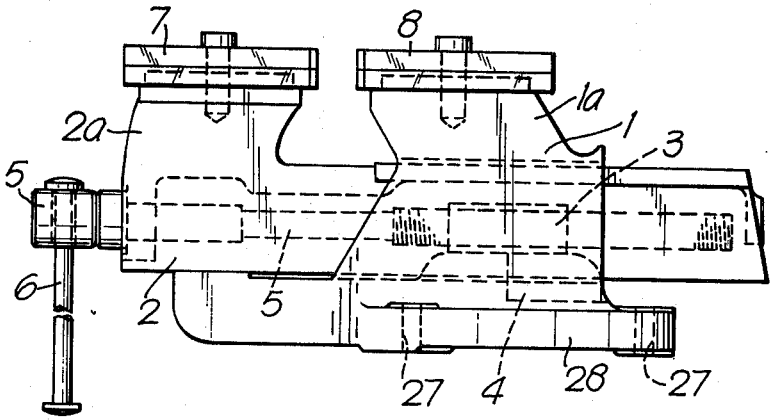
FIG. 2 is a side elevation of the vice.
Figure 3:
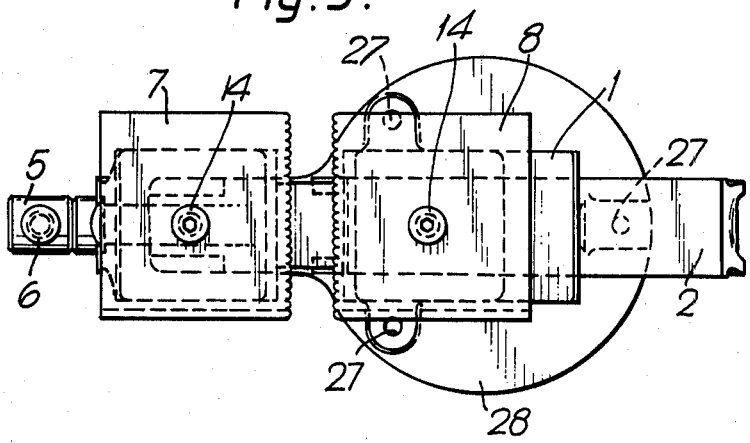
FIG. 3 is a plan view.
Figure 4:
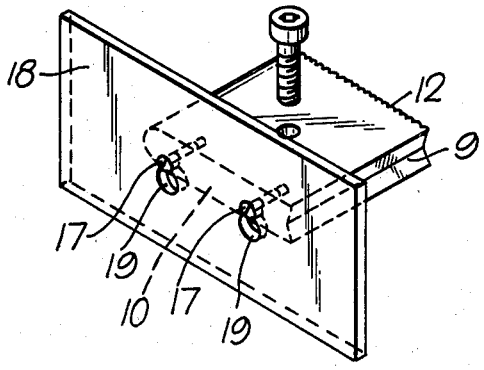
FIG. 4 is a perspective view of a jaw block to which has been attached a gripping surface.
Figure 5:
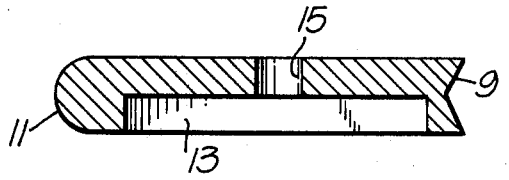
FIG. 5 is a plan view.
Figure 6:
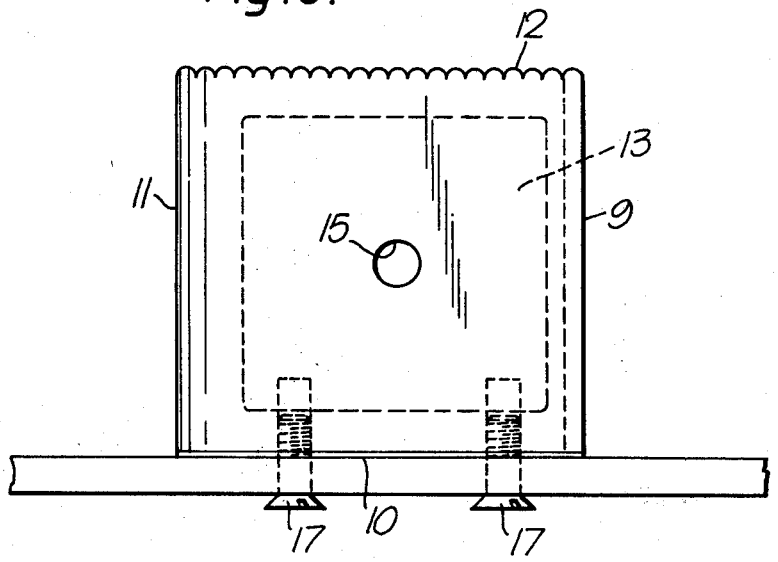
FIG. 6 is a cross-sectional view of the jaw block.

Referring to the drawings, the vice comprises a stock 1 in which is movable a slide 2. The stock 1 contains a screw threaded housing 3 integral with a base 4 shaped to fit into a prepared recess in the stock 1. The recess is wholly occupied by the base 4, which is thereby secured in position in the recess.

Extending through and supporting the slide 2 is a rod 5. The rod 5 has a screw threaded section which is located in the screw threaded housing 3. Upon rotation of the handle 6, the rod 5 moves axially within the housing 3, and in consequence also moves the slide 2. When the vice is in use, the stock 1 is bolted to a support (not shown) by means of bolts (not shown) which pass through bolt apertures 27 in a flange 28.

Supporting columns 1*a* and 2*a* are provided (respectively) on the stock 1 and slide 2 and on the columns 1*a* and 2*a* are supported jaw blocks 7 and 8 respectively.

The jaw blocks 7 and 8 each have four jaws, 9, 10, 11 and 12 of different construction. Each of the jaw blocks 7 and 8 has a recess 13 into which the top of the column 1*a* and 2*a* is adapted to fit snugly. When in position on the top of the column 1*a* or 2*a*, the jaw block 7 or 8 is held in position thereon by a single retaining pin 14, the shank of which passes through an aperture 15 in the jaw block 7 or 8 and into a socket in the column 1*a* or 2*a*. Thus the jaw block 7 or 8 may easily be turned to any one of four orientations and then maintained in that orientation, simply by removing the retaining pin 14, raising the jaw block 7 or 8 off the top of the column 1*a* or 2*a*, turning the jaw block 7 or 8, replacing the jaw block 7 or 8 on the top of the column 1*a* or 2*a*, and inserting the retaining pin 14 through the jaw block 7 or 8 and into the column 1*a* or 2*a*.

Each of the jaw blocks 7 and 8 has in one gripping surface a pair of screws 17. When not in use, the screws 17 are screwed into the jaw block 7 so that the heads of the screws are below the level of the gripping surface 10, and do not obstruct the gripping surface 10. The screws 17 may also be located so that the heads and shank portions (which are not threaded), lie outside the gripping surface 12.

The shank portions may then by utilised to support a gripping plate 18 which has keyhole shape apertures 19 by means of which the gripping plate 18 may be supported against the gripping surface 10.

I claim:

1. In a vice having a pair of gripping elements, the opposing gripping surfaces of which may be brought into engagement with a workpiece located between said gripping elements, thereby to clamp the workpiece in position, the improvement wherein at least one of said gripping elements has a gripping surface in which are provided screw threaded housings, and comprising screw threaded shanks which can be screwed home in said screw threaded housings to lie beneath the plane of said gripping surface, and which can be screwed outwardly relative to said at least one gripping element to protrude from the plane of said gripping surface, thereby to provide supports for a further gripping surface which can be suspended from the supports.

2. The vice of claim 1 including a gripping block defining the gripping surface of one of said gripping elements, said gripping block having a plurality of gripping surfaces and being mounted on said one gripping element so that it can be orientated to bring into engagement with the workpiece different ones of its gripping surfaces.

3. The vice of claim 2 wherein said gripping block is detachably mounted on said one gripping element so that it can be removed, orientated and replaced.

4. The vice of claims 2 or 3 wherein each of said gripping elements has one of said gripping blocks so mounted thereon.

5. In a vice having a pair of gripping elements, each of said gripping elements being associated with at least one gripping surface, an opposing pair of said gripping surfaces being adapted to be brought into engagement with a workpiece located between said gripping elements, thereby to clamp the workpiece in position, the improvement wherein a gripping block having a plurality of different gripping surfaces is detachably mounted on an associated one of said gripping elements so as to enable said gripping block to be removed, orientated and replaced, thereby to bring any one of said plurality of gripping surfaces thereon into opposition with the gripping surface associated with the other of said gripping element, said one gripping element comprising a support for receiving its associated gripping block, and said associated gripping block having a recess defining a roof element and internal side wall elements, said support providing a seat and external side wall elements which contact said roof and said corresponding internal side wall elements respectively of said recess when said associated gripping block is in position on said support, said associated gripping block having a plurality of gripping surfaces, one of which is parallel to the other gripping surface of the vice when said associated gripping block is in position on said support.

6. The vice of claim 5 wherein another gripping block is detachably mounted on said other of said gripping elements, thereby to enable a plurality of like gripping surfaces to be brought into opposition.

7. The vice of claim 5 including means to fix the orientation of said associated gripping block on said gripping element from a time prior to contact of said gripping block and the workpiece and until removal of said gripping block from said gripping element.

8. In a gripping element adapted for use in a vice having a pair of gripping elements, the opposing gripping surfaces of which may be brought into engagement with a workpiece located between said gripping elements, thereby to clamp the workpiece in position, the improvement wherein said gripping element has a gripping surface in which are provided screw threaded housings and screw threaded shanks which can be screwed home in said screw threaded housings to lie beneath the plane of said gripping surface, and which can be screwed outwardly relative to said gripping element to protrude from the plane of said gripping surface, thereby to provide supports for a further gripping surface which can be suspended from the supports.

9. The gripping element of claim 8 including a gripping block defining the gripping surface of said gripping element, said gripping block having a plurality of gripping surfaces and being mounted on said gripping element so that it can be orientated to bring into engagement with the workpiece different ones of its gripping surfaces.

10. In a gripping block adapted for use in a vice having a pair of gripping elements, each of said gripping elements being associated with at least one gripping surface, an opposing pair of said gripping surfaces being adapted to be brought into engagement with a workpiece located between said gripping elements, thereby to clamp the workpiece in position, at least one of said gripping elements comprising a support for receiving an associated gripping block, said support including a seat and external side wall elements, the improvement wherein said gripping block has a plurality of different gripping surfaces and is adapted to be mounted on an associated one of said gripping elements so as to enable said gripping block to be orientated to bring any one of said plurality of gripping surfaces thereon into opposition with the gripping surface associated with the other of said gripping elements, said associated gripping block having a recess defining a roof element and internal side wall elements adapted to engage said seat and external side wall elements respectively of said support when said associated gripping block is in position on said support.

* * * * *